US007085508B2

(12) United States Patent
Igarashi

(10) Patent No.: US 7,085,508 B2
(45) Date of Patent: Aug. 1, 2006

(54) TIMING CONTROL UNIT AND COLOR IMAGE FORMING APPARATUS USING THE SAME

(75) Inventor: Masatomo Igarashi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 204 days.

(21) Appl. No.: 10/698,390

(22) Filed: Nov. 3, 2003

(65) Prior Publication Data

US 2004/0208672 A1 Oct. 21, 2004

(30) Foreign Application Priority Data

Apr. 18, 2003 (JP) ..... 2003-114626

(51) Int. Cl.
*G03G 15/01* (2006.01)

(52) U.S. Cl. ..... 399/40; 347/116

(58) Field of Classification Search ..... 399/51, 399/66, 78, 301, 39, 40, 178; 347/116, 248, 347/249

See application file for complete search history.

(56) References Cited

U.S. PATENT DOCUMENTS 5,229,787 A * 7/1993 Rees et al. ..... 347/115
5,473,421 A * 12/1995 Maruyama et al. ..... 399/39
5,493,385 A * 2/1996 Ng ..... 399/40
6,307,578 B1 * 10/2001 Castelli ..... 347/116
6,560,434 B1 * 5/2003 Chapman et al. ..... 399/302

FOREIGN PATENT DOCUMENTS

JP 2000010375 A * 1/2000
JP A 2000-29268 1/2000
WO WO 97/12287 * 4/1997

* cited by examiner

*Primary Examiner*—Robert Beatty
(74) *Attorney, Agent, or Firm*—Oliff & Berridge, PLC

(57) ABSTRACT

Provided is a timing control unit that controls timing for performing a desired operation of a belt-like member at least at two operating positions including a first and second operating positions. The distance between the first and second operating positions is set to a multiple of a perimeter of the drive roll. The timing control unit includes a clock generation part for generating a clock signal having a constant period in accordance with rotation of the drive roll, and a count part for counting the clock signal generated by the clock generation part. The count part counts the clock signal generated by the clock generation part for the number corresponding to the multiple of the perimeter of the drive roll, thereby operation timing at the second operating position is synchronized with operation timing at the first operating position.

4 Claims, 10 Drawing Sheets

(A)

(B)

(A)

(B)

(A)

(B)

(A)

(B)

TIMING CONTROL UNIT AND COLOR IMAGE FORMING APPARATUS USING THE SAME

FIELD OF THE INVENTION AND RELATED ART STATEMENT

The present invention relates to a timing control unit that is preferably used for a color image forming apparatus such as a color laser beam printer or a color copying machine that utilize an electrophotography method or the like and to a color image forming apparatus that uses the same. In particular, the present invention relates to a timing control unit that is preferably used for a color image forming apparatus that is capable of forming a color image including plural images having different colors at very high speed without causing any color drift and to a color image forming apparatus that uses the same.

Conventionally, a color image forming apparatus such as a color laser beam printer or a color copying machine that utilizes the electrophotography method or the like has the following structure. The color image forming apparatus includes plural image forming portions that form images of different colors, which are disposed in a periphery of a photosensitive belt or an intermediate transferring belt. The plural image forming portions form images (toner images) of different colors on the photosensitive belt or transfer images (toner images) of different colors onto the intermediate transferring belt in a super imposed manner. After that, the toner images of different colors formed on the photosensitive belt or the intermediate transferring belt are collectively transferred onto a recording sheet and are fixed so that a color image including plural toner images of different colors is formed.

In the above-described color image forming apparatus, the image forming portion may be exchanged when toner is consumed, for example. Then, positions of the toner images of different colors that are formed or transferred on the photosensitive belt or the intermediate transferring belt by the plural image forming portions maybe shifted from each other, resulting in a color drift.

Therefore, a technique for preventing the color drift of plural toner images in a color image forming apparatus such as a color printer is proposed as disclosed in JP 2000-29268 A.

The image forming apparatus disclosed in the JP 2000-29268 A prevents a color drift that can be generated when a user exchanges the image forming portion in which the remaining quantity of developer in a developing unit becomes little with a new image forming portion, and the user did a poor installation so that the image forming portion was displaced from the ideal position. The prevention of the color drift can be performed by: forming a pattern for detecting each distance between contact points of each image bearing member of the plural image forming portions and the intermediate transferring belt on the intermediate transferring belt; reading the pattern formed on the intermediate transferring belt by a reading device such as a CCD sensor; and controlling read timing of video data in each image forming portion in accordance with the respective detected distance between the contact points of each image bearing member of the plural image forming portions and the intermediate transferring belt.

However, the above-mentioned conventional technique has a problem as described below. Namely, the image forming apparatus disclosed in the JP 2000-29268 A is aimed at correction of the color drift due to exchange of the image forming portion. Therefore, the technique can be applied to a machine that is relatively small and that has low productivity, but cannot be applied to a machine that works at high speed and that has high productivity. This is because there is a possibility that in a machine that works at high speed and that has high productivity, the image forming portion may be displaced, causing a color drift not only due to the exchange of the image forming portion but also due to a variation of environmental conditions such as temperature and humidity, which causes thermal expansion or thermal shrinkage of the photosensitive drum, the intermediate transferring belt, or a drive roll for driving the photosensitive drum or the intermediate transferring belt, or due to external force that accompanies attaching or detaching operation of a paper feed tray when replenishing sheets of paper in the paper feed tray.

Further, the image forming apparatus disclosed in JP2000-29268 A forms a pattern for detecting each distance between contact points of each image bearing member of the plural image forming portions and the intermediate transferring belt and reads the pattern by a reading device, so as to correct the color drift. Therefore, in order to cope with the variation of environmental conditions including temperature and humidity, formation and reading of the pattern have to be performed frequently during formation of an image. As a result, it is inevitable that the productivity is lowered accordingly, and the technique cannot be applied to a machine that works at high speed and that has high productivity.

In addition, the above-mentioned color image forming apparatus includes a drive roll for driving a photosensitive belt or an intermediate transferring belt. It is considered to increase accuracy of machining the drive roll for stabilizing a circulation movement of the photosensitive belt or other members. However, it is difficult to prevent eccentricity of the drive roll completely that is unique to each drive roll as shown in FIG. 3 even if the accuracy of machining is increased.

In particular, in order to realize a color image forming apparatus that can form a color image including plural toner images of different colors at an unprecedented high productivity, approximately 180 pages/minute, the following condition has to be satisfied. Namely, a photosensitive belt or an intermediate transferring belt that is driven by the drive roll is required to perform the circulation movement at very high speed. Therefore, if the drive roll for driving the photosensitive belt or the intermediate transferring belt has an eccentricity, degree of the eccentricity of the drive roll varies dynamically in accordance with a change of environment so that a surface speed of the photosensitive belt or the like is fluctuated dynamically. As a result, the above-described technique disclosed in JP 2000-29268 A cannot cope with a dynamic fluctuation of speed of the photosensitive belt, and consequently the color drift cannot be corrected.

OBJECT AND SUMMARY OF THE INVENTION

Therefore, the present invention has been made to solve the above-mentioned problems and has an object to provide a timing control unit and a color image forming apparatus using the same that can minimize the color drift due to a dynamic variation of speed of a belt-like member such as a photosensitive belt by controlling the timing of forming plural images of different colors with electrically high accuracy even for a color image forming apparatus that can form a color image including plural images of different colors at very high productivity.

In order to attain the above-mentioned object, according to the present invention, there is provided a timing control unit for controlling a timing for performing a desired operation directly or indirectly of a belt-like member at least at two operating positions including a first operating position and a second operating position separated in a circumferential direction of the belt-like member driven by a drive roll, a distance between the first operating position and the second operating position being set to a multiple of a perimeter of the drive roll, the timing control unit including: a clock generation part for generating a clock signal having a constant period in accordance with a rotation of the drive roll; and a count part for counting the clock signal generated by the clock generation part, in which the count part counts the clock signal generated by the clock generation part for a number corresponding to the multiple of the perimeter of the drive roll, thereby an operation timing at the second operating position is synchronized with an operation timing at the first operating position. Note that the drive roll is for driving the belt-like member and therefore is not limited to a roll called "drive roll".

Here, a direct or an indirect operation of the belt-like member as desired includes a direct operation of electrifying, exposure, or the like to the belt-like member, and an indirect operation to the belt-like member by transferring a toner image to a paper sheet that is conveyed by a paper conveyor belt without performing a direct operation to the paper conveyor belt in the case where the belt-like member is the paper conveyor belt.

Further, according to the present invention, for example, the count part starts to count the clock signal generated by the clock generation part when the operation at the first operating position starts, and the operation at the second operating position starts when the count part has counted the clock signal for the number corresponding to the multiple of the perimeter of the drive roll.

Further, according to the present invention, for example, the timing control unit further includes: a base clock generation part for generating a base clock signal at a period shorter than the clock generation part; and a base clock count part for counting a number of the base clocks generated by the base clock generation part during the period from a first operation timing signal for deciding the operation timing at the first operating position to the clock signal generated by the clock generation part, in which a count value of the base clock count part is used for correcting a timing difference between the first operation timing signal and the clock signal generated by the clock generation part.

Further, according to the present invention, for example, the timing control unit further includes: a base clock generation part for generating a base clock signal at a period shorter than the clock generation part; a base clock count part for counting a number of the base clocks generated by the base clock generation part during the period from a first operation timing signal for deciding the operation timing at the first operating position to the clock signal generated by the clock generation part; a memory part for storing the number of the base clocks counted by the base clock count part; and a decrement count part for decrementing a value of the base clock stored in the memory part by the number of the base clocks generated by the base clock generation part, in which the count part starts to count the clock signal in accordance with a first operation timing signal for deciding the operation timing at the first operating position, and the base clock count part counts the number of the base clocks generated by the base clock generation part during the period between the first operation timing signal and the clock signal to thereby store the counted number of the base clocks in the memory part, and the decrement count part starts to decrement the counted number of the base clocks stored in the memory part when the count part counts the clock signal for the number corresponding to the multiple of the perimeter of the drive roll, and delivers a second operation timing signal for deciding the operation timing at the second operating position when a count value of the decrement count part becomes zero.

Further, according to the present invention, there is provided a color image forming apparatus for forming a color image by successively forming toner images of different colors on a belt-like image bearing member at least at two image forming portions including a first image forming portion and a second image forming portion separated in a circumferential direction of the belt-like image bearing member driven by a drive roll, a distance between the first image forming portion and the second image forming portion being set to a multiple of a perimeter of the drive roll, the color image forming apparatus including: a clock generation part for generating a clock signal having a constant period in accordance with a rotation of the drive roll; and a count part for counting the clock signal generated by the clock generation part, in which the count part counts the clock signal generated by the clock generation part for a number corresponding to the multiple of the perimeter of the drive roll, thereby an image formation timing at a second image forming position in the second image forming portion is synchronized with an image formation timing at a first image forming position in the first image forming portion.

According to the present invention, there is provided the timing control unit and the color image forming apparatus using the same that can minimize generation of the color drift due to a dynamic fluctuation of speed of the belt-like member such as a photosensitive belt to almost zero by controlling electrically the timing of forming plural images of different colors with high accuracy even for a color image forming apparatus that can form a color image including plural images of different colors at very high productivity.

DETAILED DESCRIPTION OF THE PREFERRED EMBODIMENTS

Hereinafter, embodiments of the present invention will be explained with reference to the drawings.

First Embodiment

Figure 1:
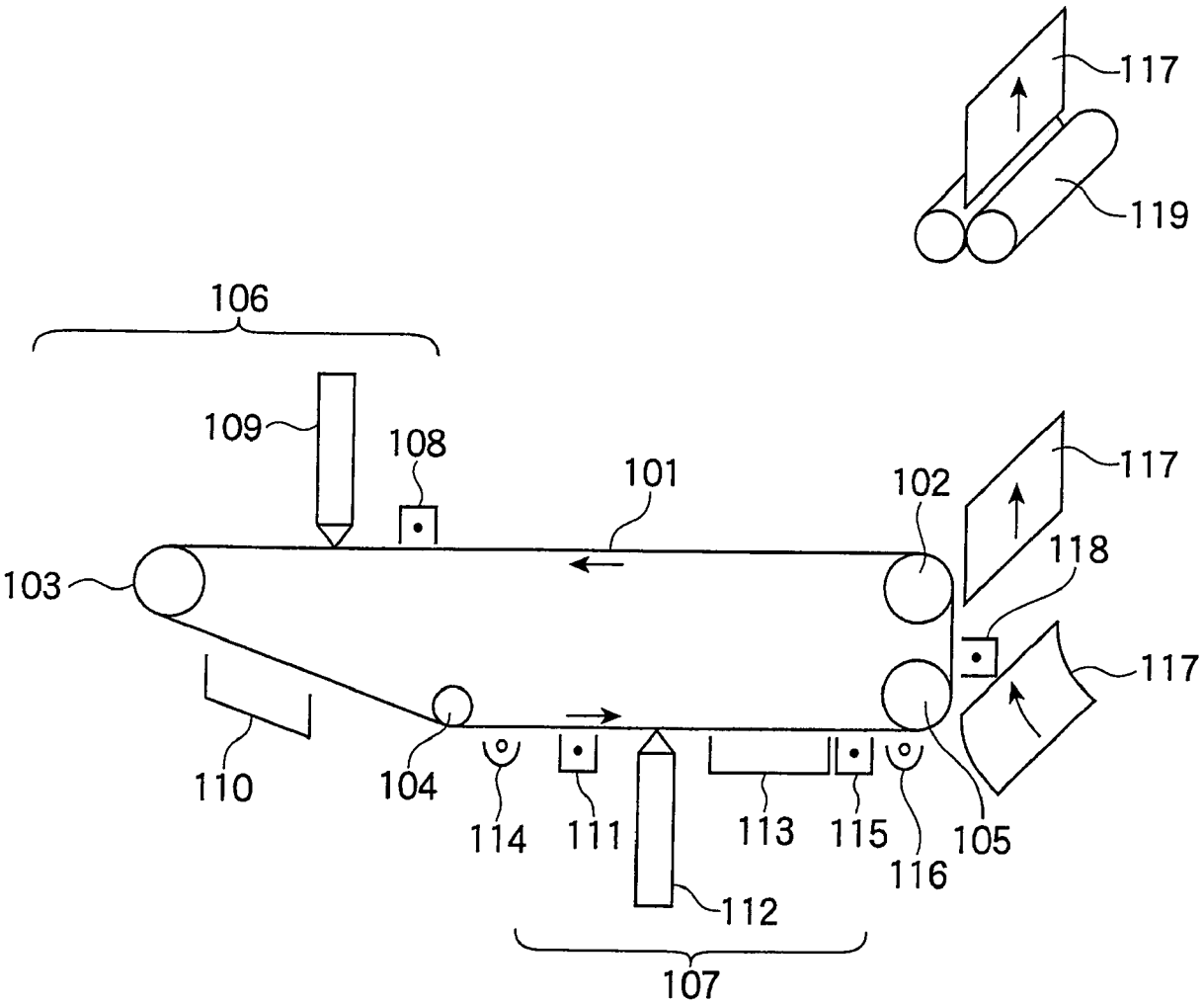
FIG. 1 is a diagram showing a structure of a color image forming apparatus according to a first embodiment of the present invention.

FIG. 1 shows a color image forming apparatus to which a timing control unit according to a first embodiment of the present invention is applied.

In FIG. 1, reference numeral 101 denotes a photosensitive belt as a belt-like image bearing member (a belt-like member). This photosensitive belt 101 is formed as an endless belt having a perimeter of approximately 1500 mm or 1700 mm and a width of approximately 300 mm or 410 mm by laminating an inorganic or organic photosensitive layer on a conductive base layer. The photosensitive belt 101 is looped over a drive roll 102, a tension roll 103 having a larger diameter than the drive roll 102, a first idler roll 104 and a second idler roll 105 with a predetermined tension. The photosensitive belt 101 is driven to turn at very high speed in a counterclockwise direction. The number of rolls for looping the photosensitive belt 101 is not limited to four but can be two or more. In addition, the tension roll 103 applies a predetermined tension to the photosensitive belt 101. This tension roll 103 may also work as a steering roll for preventing the photosensitive belt 101 from meandering.

The above-mentioned color image forming apparatus can form a color image including plural images of different colors with very high productivity of approximately 180 pages per minute. Therefore, the photosensitive belt 101 is structured to turn at very high speed of approximately 750 mm/sec as a peripheral speed (process speed), for example.

In addition, a first image forming portion 106 for forming an image of a first color (e.g., a black color) and a second image forming portion 107 for forming an image of a highlight (HL) color as a second color (e.g., one color such as a red color, a blue color, or a green color) are arranged with a predetermined distance therebetween along the circumferential direction of the photosensitive belt 101.

A color image forming apparatus that forms a two-color image including a first color (e.g., a black color) and a HL color (e.g., one color such as a red color, a blue color, or a green color) is explained in this embodiment. However, the number of the above-mentioned image forming portions is not limited to two but may be three or more including image forming portions for yellow, magenta, cyan, and black.

The first image forming portion 106 includes: a first electrification device 108 having a corotron, a scorotron, or the like; and a first color exposure device 109 having an ROS (Raster Output Scanner) for deflecting a laser beam for scanning in accordance with image information, or the like; and a first color developing device 110 for developing an electrostatic latent image with black toner. The first electrification device 108, the first color exposure device 109 and the first color developing device 110 are arranged along the moving direction of the photosensitive belt 101.

In addition, the second image forming portion 107 includes: a second electrification device 111 having a corotron, a scorotron, or the like; a second color exposure device 112 having an LED array for emitting light by a dot in accordance with image information, or the like; and a second color developing device 113 for developing an electrostatic latent image with highlight (HL) color toner such as a red color, a blue color, or a green color. The second electrification device 111, the second color exposure device 112, and the second color developing device 113 are arranged along the moving direction of the photosensitive belt 101.

In the above embodiment, a case is explained where the first color exposure device 109 has the ROS or the like, and the second color exposure device 112 has an LED array or the like. However, the structure is not limited to this. Each of the first color exposure device 109 and the second color exposure device 112 may have an ROS or an LED array or another exposure device.

In addition, a charge eliminating device 114 including an exposure lamp for diselectrifying the surface of the photosensitive belt 101 is disposed between the first image forming portion 106 and the second image forming portion 107.

Further, in the downstream portion of the second image forming portion 107, there are provided a pre-transfer electrification device 115 having a corotron for electrifying two color toner images formed on the photosensitive belt 101 by a predetermined polarity (e.g., the positive polarity) before transferring, or the like, and a diselectifying device 116 having an exposure lamp for diselectrifying the surface of the photosensitive belt 101, or the like. In addition, in the downstream portion of the diselectifying device 116, there is provided a transfer electrification device 118 having, for example, a corotron for collectively transferring two color toner images formed on the photosensitive belt 101 onto a recording sheet 117 as a recording medium that is fed at a predetermined timing. This transfer electrification device 118 is arranged so as to be opposed to the photosensitive belt 101 between the idler roll 105 and the drive roll 102.

In addition, at the upper portion of the photosensitive belt 101, there is a fixing device 119 for fixing an unfixed toner image by heat and pressure on the recording sheet 117 to which a two-color toner image is transferred from the photosensitive belt 101.

Note that, the surface of the photosensitive drum 101 after transferring the toner image is cleaned by a cleaning device (not shown) if necessary so that unfixed toner (remaining toner) and paper powder are removed.

Figure 2:
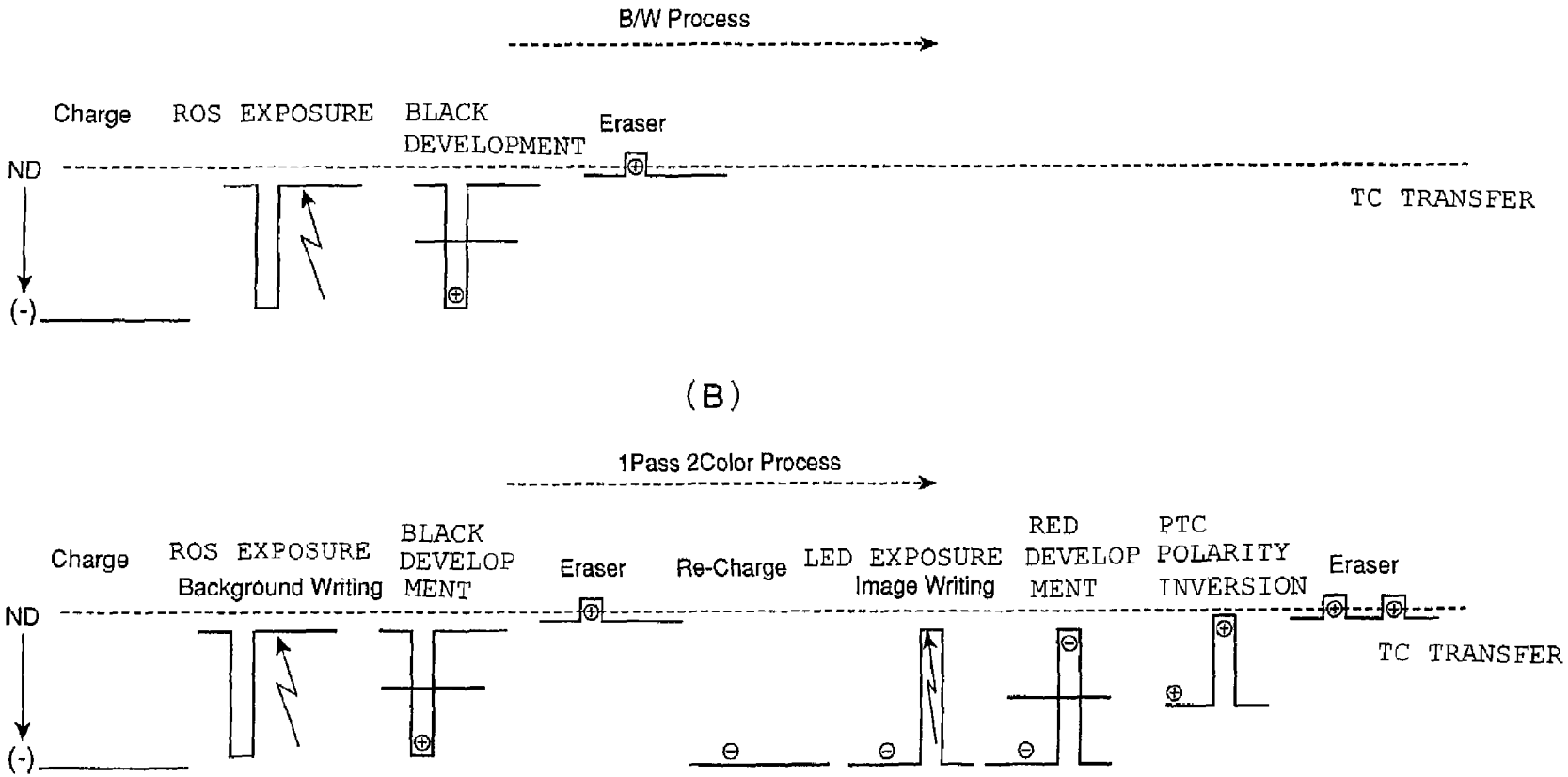
FIGS. 2A and 2B are explanatory diagrams showing an image formation process in the color image forming apparatus according to the first embodiment of the present invention.

Then, in the case where a monochrome image is formed by the above-described color image forming apparatus, a surface of the photosensitive belt 101 is electrified by the first electrification device 108 at a predetermined potential (e.g., −700 V) as shown in FIG. 2A. After that, image exposure is performed on the surface of the photosensitive belt 101 by the first exposure device 109 in accordance with black color image information, and an electrostatic latent image of a first color is formed. The electrostatic latent image formed on the photosensitive belt 101 is visualized to be a black toner image by the first color developing device 110.

Remaining charge of the black toner image formed on the photosensitive belt 101 is removed by the diselectifying device 114. After that, the black toner image passes through the second image forming portion 107 and is transferred by the transfer electrification device 118 onto the recording sheet 117 that is conveyed to the transferring position on the photosensitive belt 101 at a predetermined timing. The recording sheet 117, on which a black toner image is transferred, is separated from the photosensitive belt 101. After that, the recording sheet 117 is processed by the fixing device 119 with heat and pressure so that the black unfixed toner image is fixed and is delivered externally, finishing the monochrome image forming step.

On the other hand, in the case where a two-color image is formed that includes a monochrome image and an image of a highlight (HL) color such as a red color or a blue color in the color image forming apparatus, a surface of the photosensitive belt 101 is electrified by the first electrification device 108 at a predetermined potential (e.g., −700 V) as shown in FIG. 2B. After that, the surface of the photosensitive belt 101 is processed by the first exposure device 109 so that a background is exposed in accordance with black image information as an image exposure process (a background writing process). Thus, an electrostatic latent image of a first color is formed. The electrostatic latent image formed on the photosensitive belt 101 is developed normally with toner of the positive polarity and visualized by the first color developing device 110 so as to be a black toner image. After that, the surface of the photosensitive belt 101 on which the black toner image is formed is diselectrified with exposure by the diselectifying device 114.

Next, the surface of the photosensitive belt 101 is electrified again by the second electrification device 111 at a predetermined potential (e.g., −700 V). After that, the surface of the photosensitive belt 101 is processed by the second exposure device 112 in accordance with HL color image information as an image exposure process (an image writing process) for exposing an image portion, and a second color electrostatic latent image is formed. This second color electrostatic latent image formed on the photosensitive belt 101 is processed with reversal development with toner of the negative polarity and is visualized by the second color developing device 113 so as to be an HL color toner image.

After that, the black color toner image and the HL color toner image formed on the surface of the photosensitive belt 101 as explained above are electrified at positive polarity by the pre-transfer electrification device 115, so that the HL color toner image of the negative polarity is inverted to the positive polarity. Then, the surface of the photosensitive belt 101 is diselectrified with exposure by the diselectifying device 116.

Then, the black color toner image and the HL color toner image formed on the photosensitive belt 101 are collectively transferred by the transfer electrification device 118 onto the recording sheet 117 that is conveyed to the transferring position on the photosensitive belt 101 at a predetermined timing. The recording sheet 117 to which the black color toner image and the HL color toner image are transferred is separated from the photosensitive belt 101. After that, the recording sheet 117 is processed by the fixing device 119 with heat and pressure so that the black color unfixed toner image and the HL color unfixed toner image are fixed and is delivered externally, finishing the two-color image forming step that includes a black color and an HL color.

Further, the surface of the photosensitive drum 101 after finishing the transferring step of the toner image is cleaned by a cleaning device (not shown) if necessary so that remaining toner and paper powder are removed as preparation for the next image forming step.

In this way, in the above color image forming apparatus, a two-color image having a black color and an HL color is formed on the recording sheet 117 by the sequential image forming steps of the electrophotography method.

Note that, the color image is not limited to the above-mentioned two-color image having a black color and an HL color but may be any image. A two-color image having a black color and an HL color may be an image using an HL color such as a red color for emphasizing cautions or important items in a manual for operation or service of a machine. In addition, the above-mentioned two-color image having a black color and an HL color may be an image of a text document that is used for a training or a seminar, in which some expressions or answers are colored with an HL color such as a red color or a green color. In another example, the above-mentioned two-color image having a black color and an HL color may be an image of a business form in which some numerals are displayed with an HL color such as a red color. In still another example, the above-mentioned two-color image having a black color and an HL color may be an image of a predetermined form in a part of which a logotype of a company is displayed with an HL color that is unique to that logotype.

Figure 10:
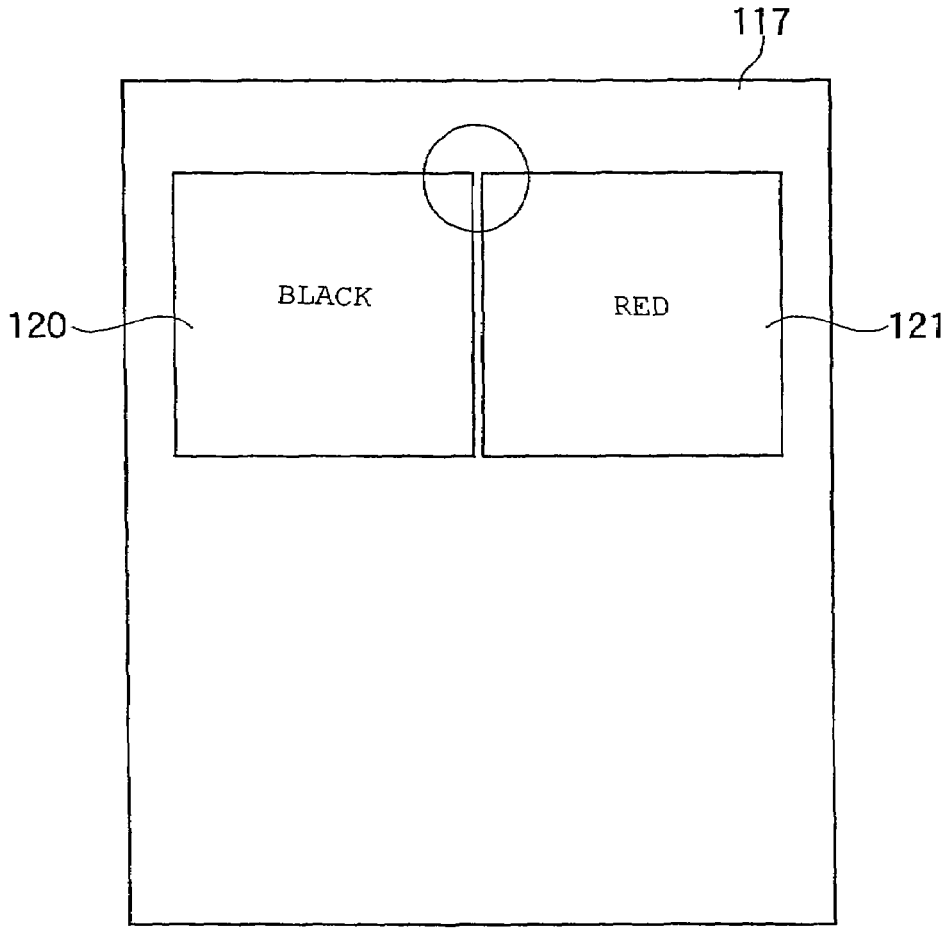
FIG. 10 is an explanatory diagram showing a color drift in a conventional color image forming apparatus.
Figure 10:
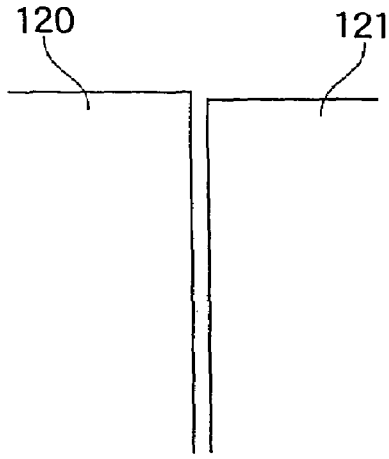

The above-mentioned two-color image having a black color and an HL color may be an image in which a black image 120 and an HL color image 122 such as a red color image are arranged side by side in the width direction of the recording sheet 117 as shown in FIG. 10, for example. In this case, if there is a difference of image writing position between the black image 120 and the HL color image 121 by a few hundred microns, the difference can be recognized by human eyes as color drift, which causes deterioration of image quality.

In addition, in the above-mentioned color image forming apparatus, the photosensitive belt 101 is moved at very high speed, e.g., at approximately 750 mm/sec as a circulation movement. As a result, if there is a difference of image write timing at approximately 1/1000 seconds between the first image forming portion 106 and the second image forming portion 107, color drift may be generated by approximately 750 μm, which becomes a conspicuous color drift. Therefore, the color drift between the black image 120 formed by the first image forming portion 106 and the HL color image 121 formed by the second image forming portion 107 should be controlled at least at 250 μm or less, preferably a few tens microns or less, more preferably a few microns or less.

Figure 3:
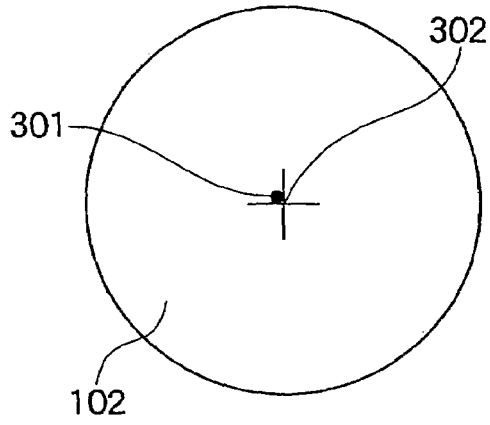
FIGS. 3A and 3B are explanatory diagrams showing an eccentricity of a drive roll.
Figure 3:
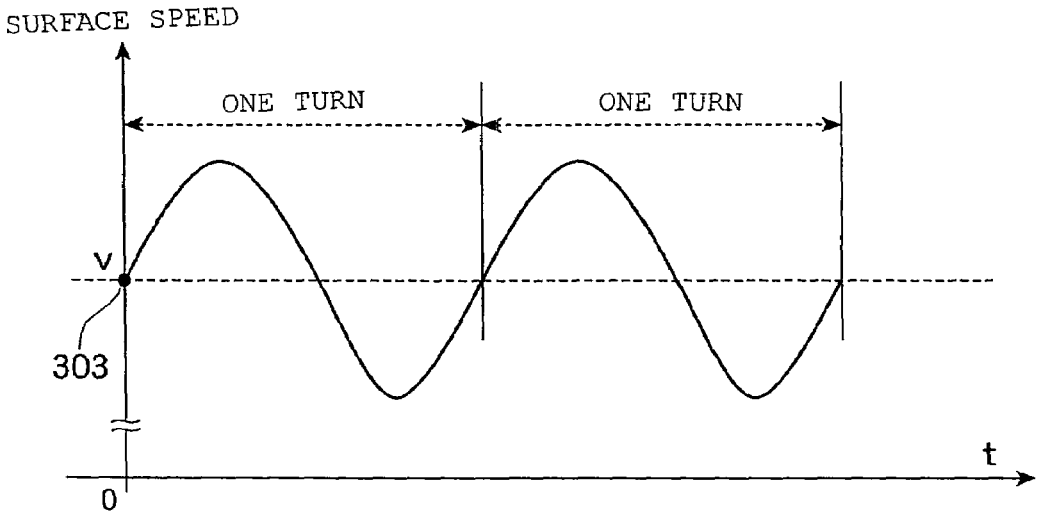

The drive roll 102 for driving the above-mentioned photosensitive belt 101 can be of various constructions. In this embodiment, the drive roll 102 is a roll made of a metal such as aluminum or a stainless steel in a cylindrical shape having an outer diameter of approximately 50 mm as shown in FIG. 3A. This drive roll 102 is driven to rotate by a drive motor such as a stepping motor (not shown) via a drive gear (not shown) that is attached to an end of the drive roll 102 in the axial direction at a constant high speed so that the photosensitive belt 101 is turned at very high speed of approximately 750 mm/sec.

However, the drive roll 102 inevitably has a so-called eccentricity, that is, the center 301 of the rotation axis is shifted from the real center 302 of the drive roll 102 as shown in FIG. 3A even if the machining accuracy thereof is improved. If there is an eccentricity in the drive roll 102 as explained above, a surface speed of the drive roll 102 is altered periodically with respect to the mean value 303 due to the eccentricity as shown in FIG. 3B even if the rotation axis of the drive roll 102 is driven to rotate at a constant angular velocity. As a result, the photosensitive belt 101 that is driven to turn by the drive roll 102 also has a fluctuation of speed, similarly to the fluctuation of surface speed of the drive roll 102.

In addition, in the case of the above-mentioned color image forming apparatus that forms a color image including two or more colors by the electrophotography method, the position of forming the two-color image including a black color and an HL color on the recording sheet 117 depends on the image exposure positions of the first color exposure device 109 and the second color exposure device 112 that perform image exposure on the photosensitive belt 101.

Concerning the positions of the first color exposure device 109 and the HL color exposure device 112 that determine the image exposure positions, if a distance between the first color exposure device 109 and the HL color exposure device 112 (a distance in the circumferential direction of the photosensitive belt 101) is set arbitrarily, the following problem will occur. That is, it is supposed that the exposure timings of the first color exposure device 109 and the second color exposure device 112 are set in so that the exposure position by the first color exposure device 109 and the exposure position by the second color exposure device 112 are overlapped with each other on the photosensitive belt 101. Even in that case, the positions of the first color image and the HL color image formed on the photosensitive belt 101 are shifted from a predetermined position due to the fluctuation of the surface speed of the photosensitive belt 101 caused by the eccentricity of the drive roll 102, and the color drift will occur in the two-color image.

Therefore, the device according to this embodiment drives the belt-like image bearing member by the drive roll and forms toner images of different colors on the belt-like image bearing member by at least two image forming portions, i.e., the first and the second image forming portions separately located in the circumferential direction of the belt-like image bearing member. The device is structured so that the distance between the first image forming portion and the second image forming portion is set to be a multiple of the perimeter of the drive roll.

Figure 4:
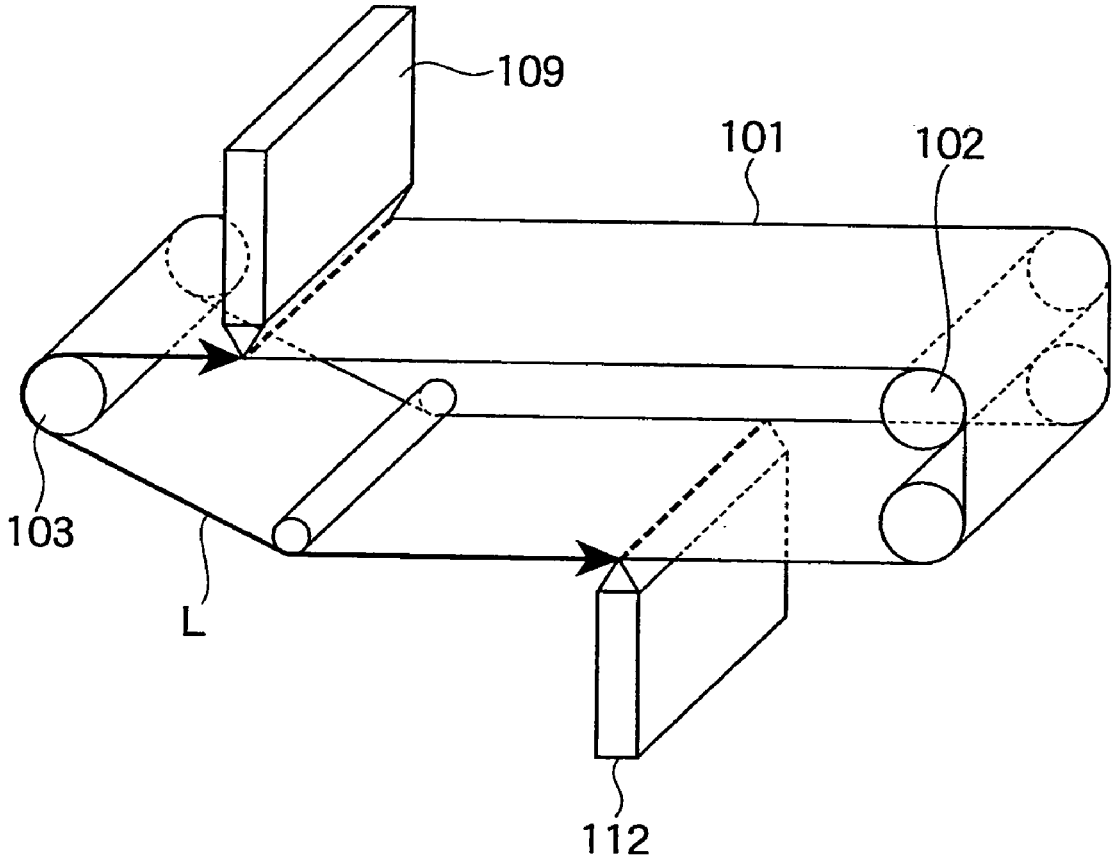
FIG. 4 is an explanatory diagram showing a main part of the color image forming apparatus according to the first embodiment of the present invention.

Namely, in this embodiment, as shown in FIG. 4, a distance L between the first color exposure device 109 and the HL color exposure device 112 (a distance in the circumferential direction of the photosensitive belt 101) is set to be a multiple of the perimeter of the drive roll 102. Here, a position of the first color exposure device 109 is not necessarily limited. Therefore HL color exposure device 112 is positioned so that the distance L between the first color exposure device 109 and the HL color exposure device 112 (a distance in the circumferential direction of the photosensitive belt 101) is set to a multiple of the perimeter of the drive roll 102. In this embodiment, the distance is set to a value four times the perimeter of the drive roll 102. However, without being limited to this value, the distance can be of any value as long as it is a multiple of the perimeter of the drive roll 102.

Further, in this embodiment, when the operation starts at the first operating position, a count part starts to count a clock signal generated by a clock generation part. When the count part counts the clock signal for the number corresponding to the multiple of the perimeter of the drive roll, the operation at the second operating position is started.

Further, in this embodiment, the device includes a base clock generation part for generating a base clock signal at a period shorter than the clock generation part and a base clock count part for counting the number of the base clocks generated by the base clock generation part during the period between the leading edge of a first operation timing signal for deciding an operation timing at the first operating position and the leading edge of the clock signal generated by the clock generation part. The device corrects a timing shift between the first operation timing signal and the clock signal generated by the clock generation part in accordance with a count value of the base clock count part.

Moreover, in this embodiment, the device includes a base clock generation part for generating a base clock signal at a period shorter than the clock generation part, a base clock count part for counting the number of the base clocks generated by the base clock generation part during the period between the leading edge of a first operation timing signal for deciding an operation timing at the first operating position and the leading edge of the clock signal generated by the clock generation part, a memory part for storing the number of the base clocks counted by the base clock count part, and a decrement count part for decrementing the base clock number stored in the memory part by the number of the base clocks generated by the base clock generation part. The count part starts to count the clock signal in accordance with the first operation timing signal for deciding the operation timing at the first operating position. The base clock count part counts the number of the base clocks generated by the base clock generation part during the period between the leading edge of a first operation timing signal and the leading edge of the clock signal. The counted number of the base clocks is stored in the memory part. When the count part counts the clock signals by the number corresponding to the multiple of the perimeter of the drive roll, the decrement count part starts to decrement the counted number of the base clocks stored in the memory part. When the count value of the decrement count part becomes zero, the second operation timing signal for deciding the operation timing at the second operating position is delivered from the decrement count part.

FIGS. 5A and 5B show a structure of a drive roll period clock generator as the clock generation part.

This drive roll period clock generator 500 includes a disk 501 attached to a shaft of the drive roll 102 in a fixed manner as shown in FIG. 5A. This disk 501 is provided with 1024 slits 502 each having a substantially rectangular shape and arranged at a constant pitch in the circumferential direction in a vicinity of the outer edge. In addition, a clock generator 503 is arranged at both sides of the disk 501 as shown in FIG. 5B. This clock generator 503 includes a light emission element 504 including an LED e and a light reception element 505 including a phototransistor, which are opposed to each other with respect to the slits 502. The drive roll period clock generator 500 is structured so that when the drive roll 102 is driven to rotate at a constant rotation speed, the clock generator 503 delivers a machine clock signal (MCLK) 506 at a constant period responding to the rotation of the drive roll 102 as shown in FIG. 5B.

Further, in this embodiment, the drive roll 102 is driven to rotate at a speed of approximately one turn per 0.2 seconds. Therefore, the period of the machine clock signal (MCLK) 506 generated by the drive roll period clock generator 500 is approximately 0.2/1024 seconds, that is, about 200 microseconds.

Figure 6:
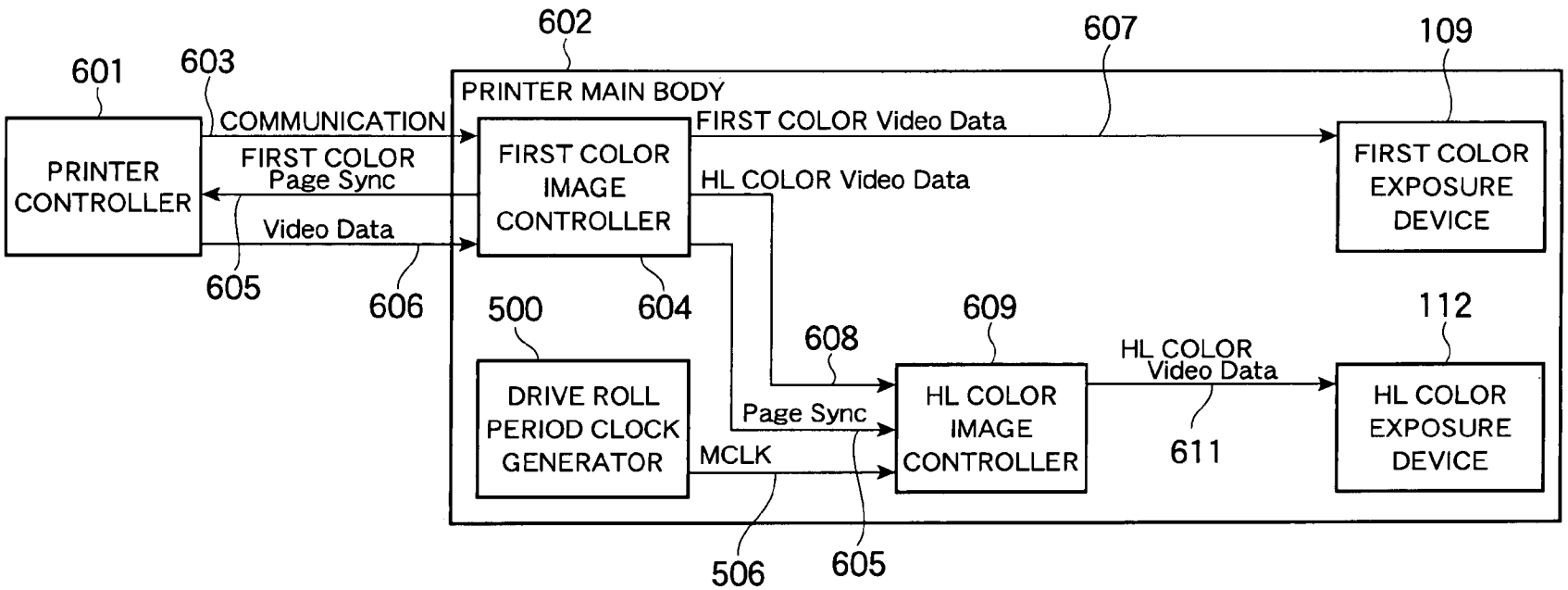
FIG. 6 is a block diagram showing a control circuit of the color image forming apparatus according to the first embodiment of the present invention.

FIG. 6 is a block diagram showing an electrical control circuit of a printer system of the color image forming apparatus (printer) according to the first embodiment of the present invention.

In FIG. 6, reference numeral 601 denotes a printer controller for controlling image forming operation of the printer. This printer controller 601 communicates with a printer main body 602 as an image output device (an image output terminal) of the color image forming apparatus by a communication signal 603. Thus, the printer controller 601 activates the image controller 604 of the printer main body 602 so as to operate the first and second image forming portions 106 and 107 and a drive system (not shown) such as a sheet conveying mechanism inside the printer main body 602.

The printer main body 602 is provided with a first color image controller 604 as shown in FIG. 6. The first color image controller 604 performs communication with the printer controller 601 using the communication signal 603 as explained above. In addition, when the first color image controller 604 delivers a first color page sync signal (Page Sync) 605 to the printer controller 601, the printer controller 601 transmits video data (Video Data) 606 that includes the first color and the second color image data to the first color printer controller 604. In addition, the first color image controller 604 delivers first color video data (Video Data) 607 to the first color exposure device 109 at a predetermined timing. Then, as explained above, the first color exposure device 109 performs the first color image exposure on the photosensitive belt 101 so that an electrostatic latent image is formed corresponding to the first color.

In addition, the first color image controller 604 separates HL color video data (Video Data) 608 of the second color from the video data (Video Data) 606. The first color image controller 604 delivers the HL color video data (Video Data) 608 and the first color page sync signal (Page Sync) 605 to the second color image controller 609. In addition, the second color image controller 609 receives the machine clock signal (MCLK) 506 from a period clock generator 500 of the drive roll 102. Further, HL color video data (Video Data) 611 is delivered from the second color image controller 609 to the HL color exposure device 112 at a predetermined timing in accordance with the first color page sync signal (Page Sync) 605 and the machine clock signal (MCLK) 506. Moreover, as explained above, the HL color exposure device 112 performs the HL color image exposure on the photosensitive belt 101, so that an electrostatic latent image corresponding to the HL color is formed.

Figure 7:
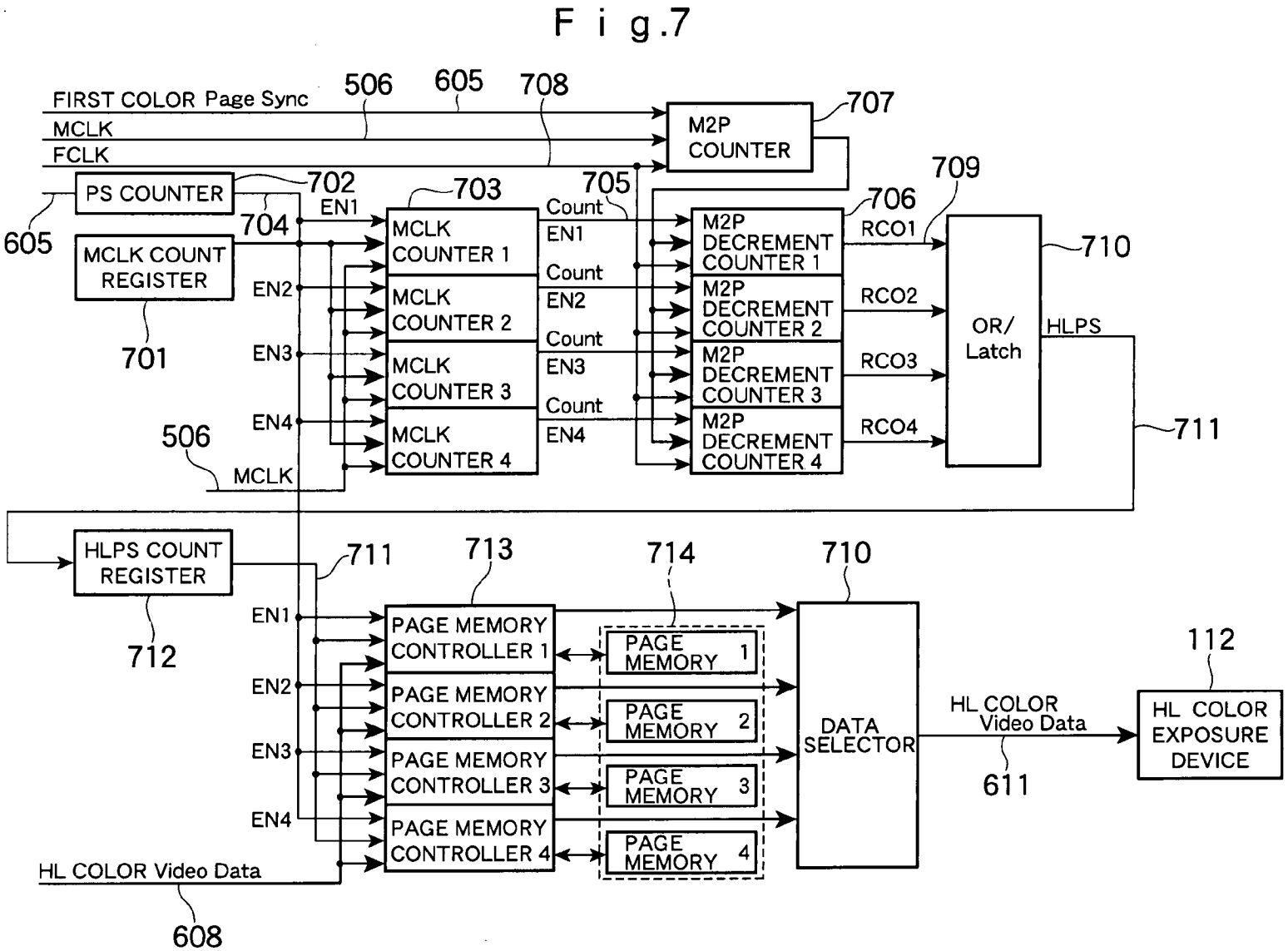
FIG. 7 is a block diagram showing a highlight color image controller.

FIG. 7 is a block diagram showing more specifically the inner configuration of the second color image controller shown in FIG. 6.

In FIG. 7, reference numeral 701 denotes a MCLK count register. This MCLK count register 701 stores a value corresponding to the number of the clocks that is delivered by the drive roll period clock generator 500 in accordance with a distance L between the exposure timing in the first color exposure device 109 and the exposure timing in the HL color exposure device 112 (a distance in the circumferential direction of the photosensitive belt).

In this embodiment, the distance L between the first color exposure position 109 and the HL color exposure position 112 is set to a value four times the perimeter of the drive roll 102. Therefore, as explained with reference to FIG. 4, the value 4095 (i=4095) is stored, which is 4096 minus one, and 4096 is four times 1024 that is the number of the clocks delivered from the drive roll period clock generator 500 every time when the drive roll 102 rotates one turn.

Further, the value of the MCLK count register 701 can be set to any value by an engineer or others who enter the value from a console panel (not shown) of the printer main body 602. When the first color exposure device 109 and the HL color exposure device 112 are attached or the attachment positions are adjusted, the value of the MCLK count register 701 is changed arbitrarily, so that a fine adjustment in correspondence with an actual machined can be performed.

In addition, the page sync (PS) counter 702 counts the number of the page sync signal (Page Sync) 605 delivered from the printer main body 602 to the printer controller 601 as shown in FIG. 7. If the count number is 4 n+1 (n is an integer), an enable (EN) signal 704 is delivered for enabling a first MCLK counter 703 as the count part. In addition, the page sync (PS) counter 702 delivers the enable (EN) signal 704 that enables a second MCLK counter 703 as the count part if the count number is 4 n+2, enables a third MCLK counter 703 as the count part if the count number is 4 n+3, and enables a fourth MCLK counter 703 as the count part-if the count number is 4 n+4. Further, each of the first through fourth MCLK counters 703 counts the number of the MCLK signals 506 delivered from the drive roll period clock generator 500.

Here, there are provided four MCLK counters 703 as count parts for the following reason. In this embodiment, the distance between the first color exposure position 109 and the HL color exposure position 112 is set to a value a little larger than the total length of two recording sheets 117 (smaller than the total length of three sheets), so that images can be formed on at least two or approximately three recording sheet 117 during the period from the first color exposure position 109 to the HL color exposure position 112.

Therefore, in this embodiment, there are four MCLK counters 703 as count parts for deciding write start positions of HL color images in the four images so that four images can be formed corresponding to four recording sheets 117 during the period from the first color exposure position 109 to the HL color exposure position 112 with some margin. Further, the number of the MCLK counter 703 can be arbitrarily adjusted in accordance with a structure such as the number of colors to be formed or the number of recording sheets 117.

In addition, any one of the MCLK counters 703 becomes enabled state responding to the enable (EN) signal 704 delivered from the page sync (PS) counter 702. Then, the MCLK counter 703 that has become the enabled state starts to count the number of the MCLK signals 506 delivered from the drive roll period clock generator 500. When the count value of the MCLK counter 703 reaches a value that is set in the MCLK count register 701, the MCLK counter 703 delivers the count enable signals (Count EN1–EN4) 705 to an M2P decrement counter 706 as a corresponding decrement count part.

In addition, as shown in FIG. 8A, when the MCLK signal 506 delivered from the drive roll period clock generator 500 rises at the timing 800, a M2P counter 707 starts to count the FCLK 708 as the base clock delivered from the base clock generation part (not shown). When the MCLK signal 505 rises again at the timing 801, it is automatically reset so as to start to count the FCLK 708 again. In addition, when the first color page sync signal (Page Sync) 605 rises at the timing 802 before the next MCLK signal 505 rises, the M2P counter 707 loads the M2P decrement counter 706 as a decrement count part with the count value during the period from the start of counting the FCLK 708 to the timing 802 when the first color page sync signal (Page Sync) 605 rises ("i" in the illustrated example).

In this embodiment, a crystal oscillator of 50 MHz is used as the base clock generation part. A base clock signal generated by the crystal oscillator is used as the FCLK 708. Therefore, the period T of the FCLK 708 as the base clock is substantially shorter than the MCLK signal 506 delivered from the drive roll period clock generator 500. Namely, T=1/f=1/(50 MHz)=20 nanoseconds.

In this way, as shown in FIG. 8A, when the first color page sync signal (Page Sync) 605 rises at the timing 802, the M2P counter 707 loads the M2P decrement counter 706 with the count value of the M2P counter 707.

In addition, when the count enable signal (Count EN) 705 is supplied from the MCLK counter 703, the M2P decrement counter 706 decrements the loaded value by the number (i) of the FCLK 708 step by step. When the count value becomes zero, carry signals (RCO1–RCO4) 709 are generated. As shown in FIG. 7, the carry signal (RCO) 709 generated by the M2P decrement counter 706 is supplied as the HL color page sync signal (Page Sync) 711 into an HLPS count register 712 that retains the HL color page sync signal (Page Sync) 711 via a latch circuit 710 that has a function of an OR circuit. This HLPS count register 712 delivers the HL color page sync signal (Page Sync) 711 to a page memory controller 713.

In addition, the second color image controller 609 is provided with four page memories 714 for storing four pages of the HL color video data (Video Data) 608. Those four page memories 714 are structured so that the corresponding page memory controller 713 controls write and read operations of the video data (Video Data) 608. Further, each of the four page memories 714 stores the HL color video data (Video Data) 608 of the corresponding page at a predetermined timing.

When the HL color page sync signal (Page Sync) 711 is supplied from the HLPS count register 712, one of the four page memories controllers 713 read out the HL color video data (Video Data) 608 stored in the page memory 714 and delivers the data as the HL color video data (Video Data) 611 to the HL color exposure device 112 via a data selector 715.

According to the above-described structure of a color image forming apparatus to which the timing control unit according to this embodiment is applied, even if it is a color image forming apparatus that forms a color image including plural images of different colors with very high productivity, generation of color drift due to a dynamic fluctuation of speed in the belt-like member such as a photosensitive belt can be minimized to almost zero by controlling electrically the timing of forming plural images of different colors at high accuracy as follows.

Figure 5:
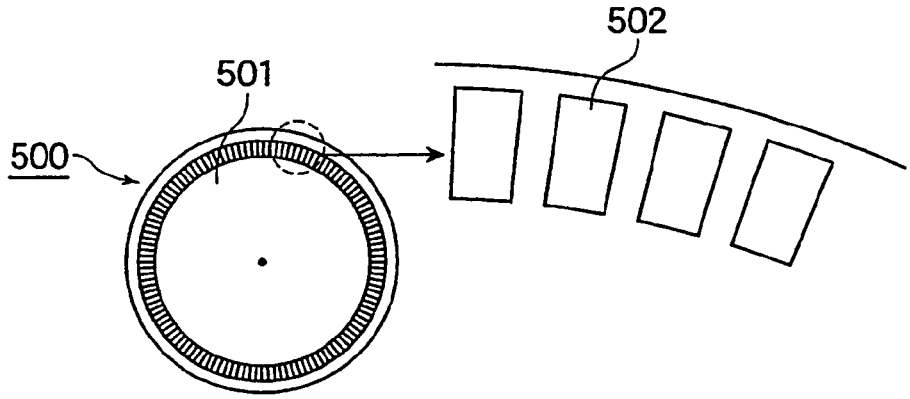
FIGS. 5A and 5B are diagrams showing a structure of a drive roll period clock generator.
Figure 5:
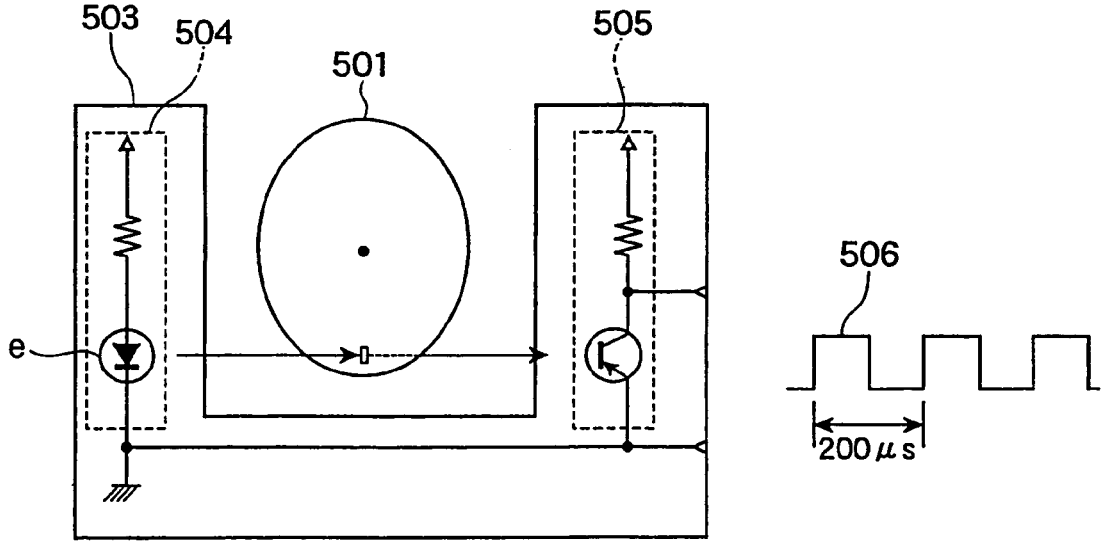
Figure 9:
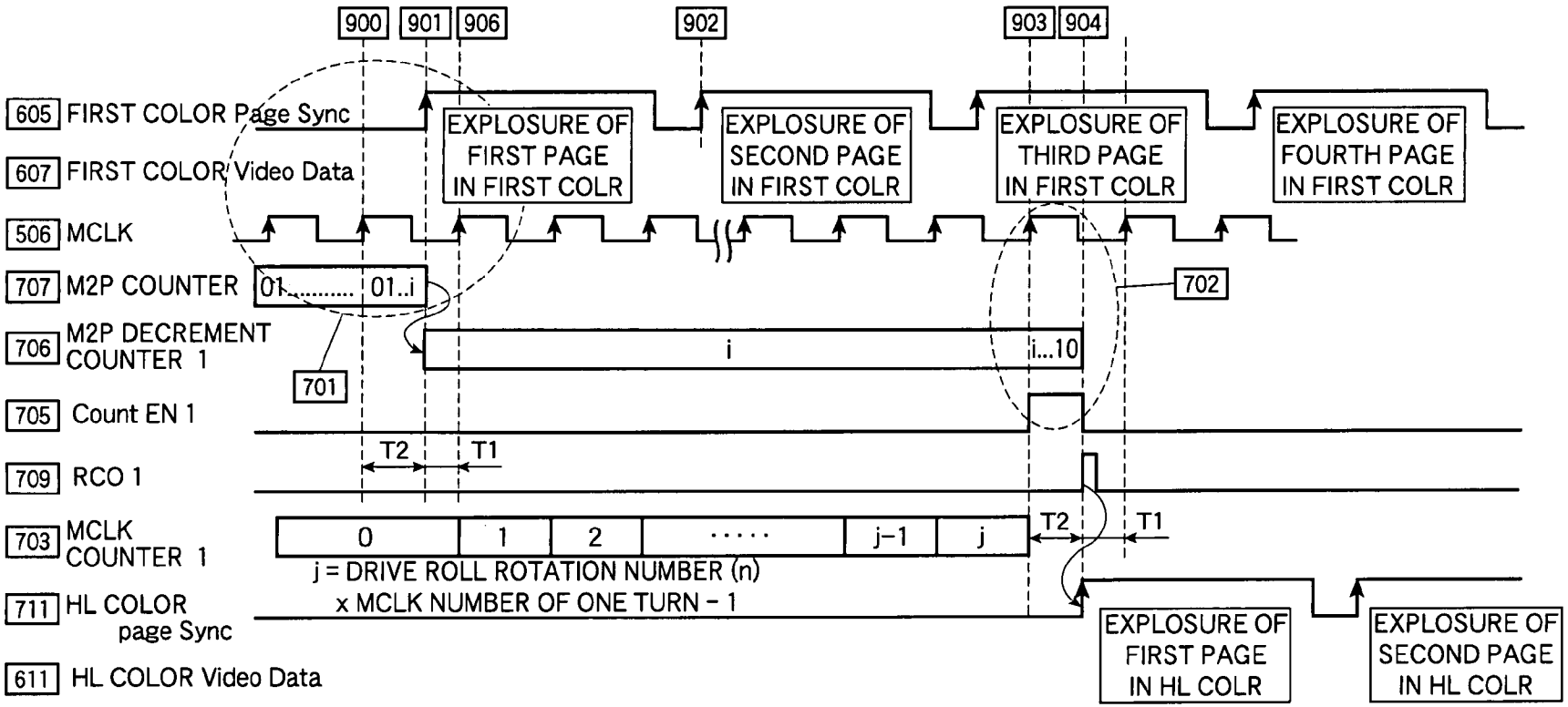
FIG. 9 is a timing chart showing an operation of the highlight color image controller.

Namely, as shown in FIG. 1, in the color image forming apparatus according to this embodiment, when forming a color image including two-color toner images of a black color and an HL color, the drive roll 102 is driven to rotate by a drive source (not shown), so that the photosensitive belt 101 is driven to turn at a predetermined circumferential speed (at approximately 750 mm/sec). Then, the drive roll period clock generator 500 that is provided at the end of the drive roll 102 delivers the machine clock signal (MCLK) 506 at a constant period as shown in FIGS. 5 and 9.

Moreover, in the above-mentioned color image forming apparatus as shown in FIG. 7, the M2P counter 707 receives the FCLK 708 that is the base clock signal together with the first color page sync signal (Page Sync) 605 and the machine clock signal (MCLK) 506. This M2P counter 707 counts the number of the FCLK 708 delivered during the period from a leading edge of the machine clock signal (MCLK) 506 to the next leading edge of the machine clock signal (MCLK) 506 as shown in FIG. 9. In addition, if a page sync signal (Page Sync) 605 of a first page in the first color that is a first image forming signal is delivered during the period from the leading edge of the machine clock signal (MCLK) 506 to the next leading edge of the machine clock signal (MCLK) 506, the M2P counter 707 works as follows. Namely, the M2P counter 707 counts the number of FCLK 708 delivered during the period from the leading edge 900 of the machine clock signal (MCLK) 506 to the leading edge 901 of the page sync signal (Page Sync) 605 of the first page in a first color (that corresponds to i=time period T2 in the illustrated example). Then, the count number (that corresponds to i=time period T2 in the illustrated example) is loaded into the M2P decrement counter 706.

Moreover, in the above-mentioned color image forming apparatus as shown in FIG. 1, before the image exposure, the surface of the photosensitive belt 101 is electrified to a predetermined potential (e.g., −700 V) by the electrification device 108 of the first image forming portion 106. After that, the surface of the photosensitive belt 101 is processed by the first color exposure device 109 as the image exposing process in accordance with the first color video data (Video Data) 607, and an electrostatic latent image corresponding to a first color of a black color is formed on the surface of the photosensitive belt 101.

On this occasion, the first color video data (Video Data) 607 used for the exposure by the first color exposure device 109 is sent as the video data (Video Data) 606 to the first color image controller 604 of the printer main body 602 from the printer controller 601 together with the HL color video data (Video Data) 608 as shown in FIG. 6. This timing is set from the printer main body 602 to the printer controller 601 simultaneously with the timing 901 when the page sync signal (Page Sync) 605 of the first page in a first color is delivered, as shown in FIG. 9. Then, the first color image controller 604 of the printer main body 602 delivers the first color video data (Video Data) 607 to the first exposure device 109 so as to start the image exposure.

On this occasion, when the first color page sync signal (Page Sync) 605 rises at the timing 901, the MCLK counter 703 starts to count the machine clock signal (MCLK) 506 delivered from the drive roll period clock generator 500, as shown in FIG. 9.

The MCLK counter 703 that counts the machine clock signal (MCLK) 506 is determined by the enable signal (EN) 704 delivered from the PS counter 702, as explained above. Namely, if the first color page sync signal (Page Sync) 605 is the page sync signal (Page Sync) 605 of the first page, the first MCLK counter 703 becomes the enabled state. In addition, if the first color page sync signal (Page Sync) 605 is the page sync signal (Page Sync) 605 of the second page, the second MCLK counter 703 becomes the enabled state and starts to count the machine clock signal (MCLK) 505.

Further, the HL color video data (Video Data) 608 supplied to the first color image controller 604 of the printer main body 602 is separated from the first color video data (Video Data) 607 by the first color image controller 604 and then are temporarily stored in the page memory 714 as shown in FIG. 7.

By the way, the first color video data (Video Data) 607 and the HL color video data (Video Data) 608 delivered from the printer controller 601 to the first color image controller 604 of the printer main body 602 can be data that are transmitted from a host computer such as a personal computer. Alternatively, the data can be any video data (Video Data) read by an image reader device or transmitted through a communication line such as a telephone network or an LAN.

After that, the first color electrostatic latent image formed on the surface of the photosensitive belt 101 is normally developed with black toner by the first developing device 110 as shown in FIG. 1. After that, remaining charge is removed by the diselectifying device 114.

In addition, if the first color video data (Video Data) 607 exist over plural pages, the page sync signal (Page Sync) 605 of the first page in a first color is followed by the page sync signal (Page Sync) 605 of the second page in the first color that is delivered at a predetermined timing 902, and similar operations are repeated as shown in FIG. 9.

Next, the surface of the photosensitive belt 101 is electrified again to a predetermined potential (e.g., −700 V) by the electrification device 111 of the second image forming portion 107. After that, the surface of the photosensitive belt 101 is processed by the HL color exposure device 112 in accordance with the HL color video data (Video Data) 608 as the image exposure, and an electrostatic latent image corresponding to the HL color is formed on the surface of the photosensitive belt 101.

Before that, the video data (Video Data) 608 of the first page of the HL color that is used for exposure by the second exposure device 112 is temporarily stored in the page memory 714 included in the HL color image controller 609 of the printer main body 602, as explained above. The video data (Video Data) 608 of the first page of the corresponding HL color stored in the page memory 714 is read out from the page memory 714 by the page memory controller 713 at a predetermined timing as shown in FIG. 7, and the data are delivered to the HL color exposure device 712.

To elaborate, in the color image forming apparatus as shown in FIG. 1, the drive roll 102 is driven to rotate, and the photosensitive belt 101 is moved to turn at very high speed of approximately 750 mm/sec. Then, the drive roll period clock generator 500 that is attached to the end of the drive roll 102 delivers the machine clock signal (MCLK) 506 at a predetermined period as shown in FIG. 9. This machine clock signal (MCLK) 506 is received by the MCLK counter 703 as explained above, and the MCLK counter 703 counts the machine clock signal (MCLK) 506.

As shown in FIG. 9, when the page sync signal (Page Sync) 605 of the first page in a first color is delivered at the timing 901, the MCLK counter 703 starts to count the machine clock signal (MCLK) 506 delivered from the drive roll period clock generator 500. After that, when the count value of the machine clock signal (MCLK) 506 reaches a predetermined value (j=4095) stored in the MCLK count register 701 in advance, the MCLK counter 703 delivers a count enable signal (Count EN1) 705 to the M2P decrement counter 706.

Here, the predetermined value stored in the MCLK count register 701 in advance is set not to a value 4096 that is four times the value 1024, i.e., the number of the machine clock signal (MCLK) 505 delivered when the drive roll period clock generator 500 rotates one turn, but to a value 4095 because of the following reason.

That is, the first color page sync signal (Page Sync) 605 and the machine clock signal (MCLK) 506 are asynchronous signals as shown in FIG. 9. In this embodiment, after the first color page sync signal (Page Sync) 605 rises at the timing 901, count of the machine clock signal (MCLK) 506 is started. Therefore, when the MCLK counter 703 finishes counting 4096 machine clock signals (MCLK) 506 at the timing 905, the leading edge of the image that is exposed by the first exposure device 109 has already passed the position of the HL color exposure device 112, though slightly. A degree of the excess travel corresponds to the time period T1 from the leading edge 901 of the first color page sync signal (Page Sync) 605 to the next rising of the machine clock signal (MCLK) 505 at the timing 906.

Therefore, in this embodiment, the count value to be stored in the MCLK count register 701 is set to 4095 that is 4096 minus one. Then, after the page sync signal (Page Sync) 605 of the first page in a first color rises at the timing 901, the MCLK counter 703 first counts 4095 machine clock signals (MCLK) 506. On this occasion, when the MCLK counter 703 counts the 4095 machine clock signals (MCLK) 506, the time period T1 has already passed, which is from the first leading edge 901 of the first color page sync signal (Page Sync) 605 to the next rising of the machine clock signal (MCLK) 505 at the timing 906. Therefore, in order to match the count number of the machine clock signal (MCLK) 506 exactly with 4096, setting is effected such that the HL color page sync signal (Page Sync) 711 is delivered when the time T−T1=T2 further passed, and the second exposure device 112 starts to perform the exposure. Further, reference symbol T denotes a period of the machine clock signal (MCLK) 506.

In this embodiment, it is set that after the MCLK counter 703 counts 4095 machine clock signals (MCLK), the HL color exposure device 112 starts to perform the image exposure when one more time period T of the machine clock signal (MCLK) passed. That is, it is set that the HL color exposure device 112 starts to perform the image exposure when the total time T passed, which is the sum of the time period T1 from the leading edge of the first color page sync signal (Page Sync) 605 to the leading edge of the next machine clock signal (MCLK) and the time period T2 from the leading edge 900 of the previous (preceding) machine clock signal (MCLK) to the leading edge 901 of the first color page sync signal (Page Sync) 605.

Therefore, the time T2 from the leading edge 900 of the machine clock signal (MCLK) to the leading edge 901 of the first color page sync signal (Page Sync) 605 is counted by the M2P counter 707 in advance. Then, the time until the MCLK counter 703 finishes to count 4095 machine clock signals (MCLK) is added to the time T1 from the leading edge 901 of the first color page sync signal (Page Sync) 605 to the timing 906 when the MCLK counter 703 starts to count the machine clock signal (MCLK), and further the time T2 counted by the M2P counter 707 is added to the time. Therefore, the HL color exposure device 112 starts the HL color image exposure after the MCLK decrement counter 706 finish decrementing (i.e., after the time T2 passed). As a result, during the time from the leading edge 901 of the first color page sync signal (Page Sync) 605 to the leading edge 904 of the next HL color page sync signal (Page Sync) 605, T1+4095 machine clock signals (MCLK)+T2=4096 machine clock signals (MCLK) (Here, T1+T2=T) can be counted with very high accuracy.

Figure 8:
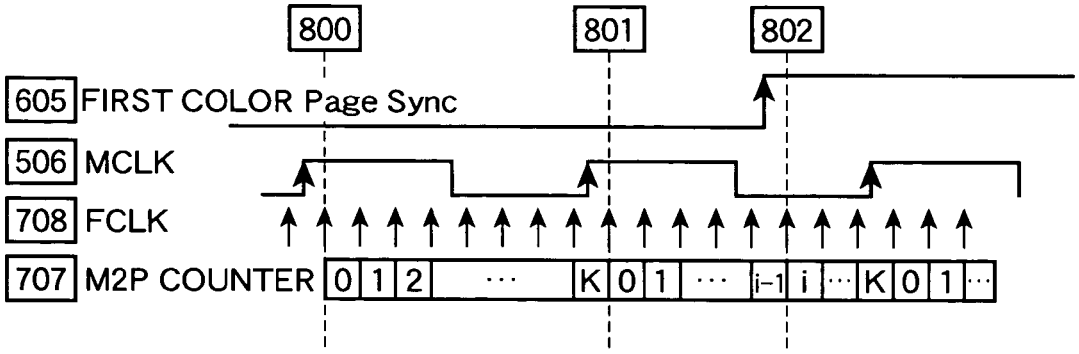
FIGS. 8A and 8B are timing charts showing an operation of the highlight color image controller.
Figure 8:
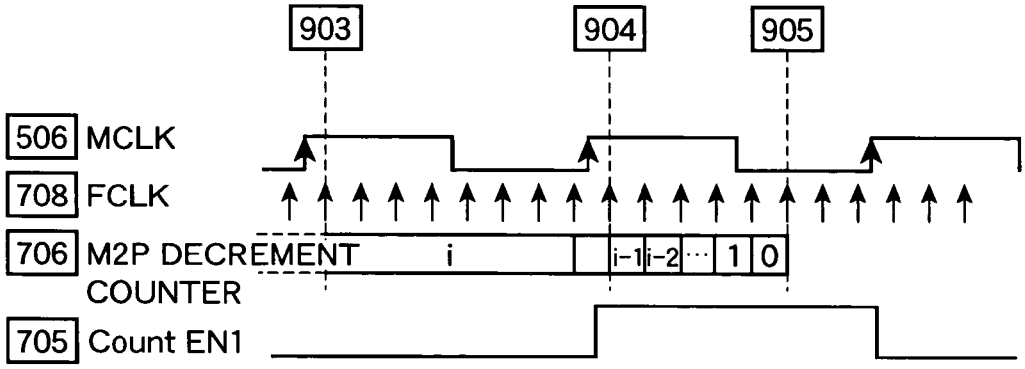

Theoretically, as shown in FIG. 8, when counting the time T2 from the leading edge 900 of the machine clock signal (MCLK) to the leading edge 901 of the first color page sync signal (Page Sync) 605, there is a possibility that a time difference may be generated corresponding to one period of the FCLK 708.

However, the period T of the FCLK 708 is defined as explained above, i.e., T=1/f=1/(50 MHz)=20 nanoseconds; it is a very short time. Therefore, color drift between the black image and the HL color image can be theoretically reduced to 20 nanoseconds×750 mm/sec=$1.5\times10^{-5}$ (mm) =0.015 (μm); it is approximately zero.

In this embodiment, in order to perform the above-mentioned operation, the time period T2 from the leading edge 900 of the machine clock signal (MCLK) 506 to the leading edge 901 of the page sync signal (Page Sync) 605 of the first page in a first color is counted by the M2P counter 707, as explained above. Then, the count number (that corresponds to i=time period T2 in the illustrated example) is loaded into the M2P decrement counter 706.

When the MCLK counter 703 finishes counting 4095 machine clock signals (MCLK), the MCLK counter 703 delivers the enable signal (Count EN1) 705 to the M2P decrement counter 706, as shown in FIGS. 7 and 9. Then, the M2P decrement counter 706 decrements the loaded count number (that corresponds to i=time period T2 in the illustrated example) sequentially by FCLK 708. When the count number becomes zero, the carry signal (RCO) 709 is delivered as shown in FIG. 9.

The carry signal (RCO) 709 delivered from the M2P decrement counter 706 is supplied to the page memory controller 713 via the latch circuit 710 and the HLPS count register 712, as shown in FIG. 7. Then, the page memory controller 713 read out the video data (Video Data) 608 of the HL color of the first page from the corresponding page memory 714 and delivers the data to the HL color exposure device 112 via the data selector 715.

As explained above with reference to FIG. 9, the timing when the video data (Video Data) 608 of the HL color of the first page is supplied to the HL color exposure device 112 can match the timing when 4096 machine clock signals (MCLK) are counted precisely after the video data (Video Data) 607 of the first page in a first color is delivered in synchronization with the first color page sync signal (Page Sync) 605, i.e., when the photosensitive belt 101 is moved by the distance L from the first exposure device 109 to the HL color exposure device 112.

Therefore, even if there is a variation of environmental conditions including temperature and humidity in the color image forming apparatus, or external force or the like is applied or even if the drive roll 102 for driving the photosensitive belt 101 has an eccentricity as shown in FIG. 3B, the number of the clock signals (MCLK) 506 delivered from the drive roll period clock generator 500 does not vary from the number 1024 when the drive roll 102 rotates one turn despite of the fluctuations of the outer diameter of the drive roll 102 or the photosensitive belt 101, etc. due to the fluctuations of the temperature or other factors.

As explained above, the distance L between the first exposure device 109 and the HL color exposure device 112 is set to a multiple (four times in this embodiment) of the perimeter of the drive roll 102, and the time period from the image exposure timing by the first exposure device 109 to the image exposure timing by the HL color exposure device 112 is matched precisely with the time corresponding to four times the perimeter of the drive roll 102, i.e., 4096 clock signals (MCLK) 506 delivered from the drive roll period clock generator 500. Thus, the first color image and the HL color image can be formed on the recording sheet 117 without color drift.

Therefore, according to the above-described color image forming apparatus, even if it is a color image forming apparatus that forms a color image including plural images of different colors with very high productivity, generation of color drift due to a dynamic fluctuation of speed generated in the belt-like member such as a photosensitive belt can be suppressed to almost zero by electrically controlling the timing etc., or forming the plural images of different colors with high accuracy.

What is claimed is:

1. A timing controller to control a timing for performing a desired operation directly or indirectly on a belt-like member at least at two operating positions including a first operating position and a second operating position separated in a circumferential direction of the belt-like member driven by a drive roll, a distance between the first operating position and the second operating position being set to a multiple of a perimeter of the drive roll, the timing controller comprising:

a clock generator to generate a clock signal having a constant period in accordance with a rotation of the drive roll;

a counter to count the clock signal generated by the clock generator, wherein the counter counts the clock signal generated by the clock generator for a number corresponding to the multiple of the perimeter of the drive roll, thereby an operation timing at the second operating position is synchronized with an operation timing at the first operating position;

a base-clock generator to generate a base-clock signal at a period shorter than the clock generator; and a base-clock counter to count a number of the base-clocks generated by the base-clock generator during the period from a first operation timing signal for deciding the operation timing at the first operating position to the clock signal generated by the clock generator, wherein a count value of the base-clock counter is used to correct an operation timing at the second operating position.

2. A timing controller to control a timing for performing a desired operation directly or indirectly on a belt-like member at least at two operating positions including a first operating position and a second operating position separated in a circumferential direction of the belt-like member driven by a drive roll, a distance between the first operating position and the second operating position being set to a multiple of a perimeter of the drive roll, the timing controller comprising:

a clock generator to generate a clock signal having a constant period in accordance with a rotation of the drive roll;

a counter to count the clock signal generated by the clock generator, wherein the counter counts the clock signal generated by the clock generator for a number corresponding to the multiple of the perimeter of the drive roll, thereby an operation timing at the second operating position is synchronized with an operation timing at the first operating position;

a base-clock generator to generate a base-clock signal at a period shorter than the clock generator;

a base-clock counter to count a number of the base-clocks generated by the base-clock generator during the period from a first operation timing signal for deciding the operation timing at the first operating position to the clock signal generated by the clock generator;

a memory to store the number of the base-clocks counted by the base-clock counter; and a decrement counter to decrement a value of the base-clock stored in the memory by the number of the base-clocks generated by the base-clock generator, wherein the counter starts to count the clock signal in accordance with a first operation timing signal for deciding the operation timing at the first operating position, and the base-clock counter counts the number of the base-clocks generated by the base-clock generator during the period between the first operation timing signal and the clock signal to thereby store the counted number of the base-clocks in the memory, and the decrement counter starts to decrement the counted number of the base-clocks stored in the memory when the counter counts the clock signal for the number corresponding to the multiple of the perimeter of the drive roll, and delivers a second operation timing signal for deciding the operation timing at the second operating position when a counter of the decrement counter becomes zero.

3. A color image forming apparatus for forming a color image by successively forming toner images of different colors on a belt-like image bearing member at least at two image forming portions including a first image forming portion and a second image forming portion separated in a circumferential direction of the belt-like image bearing member driven by a drive roll, a distance between the first image forming portion and the second image forming portion being set to a multiple of a perimeter of the drive roll, the color image forming apparatus comprising:

a clock generator to generate a clock signal having a constant period in accordance with a rotation of the drive roll;

a counter to count the clock signal generated by the clock generator, wherein the counter counts the clock signal generated by the clock generator for a number corresponding to the multiple of the perimeter of the drive roll, thereby an image formation timing at a second image forming position in the second image forming portion is synchronized with an image formation timing at a first image forming position in the first image forming portion;

a base-clock generator to generate a base-clock signal at a period shorter than the clock generator; and a base-clock counter to count a number of the base-clocks generated by the base-clock generator during the period from a first image formation timing signal for deciding the image formation timing at the first image forming position to the clock signal generated by the clock generator, wherein a count value of the base-clock counter is used for correcting an operation timing at the second image forming position.

4. A color image forming apparatus for forming a color image by successively forming toner images of different colors on a belt-like image bearing member at least at two image forming portions including a first image forming portion and a second image forming portion separated in a circumferential direction of the belt-like image bearing member driven by a drive roll, a distance between the first image forming portion and the second image forming portion being set to a multiple of a perimeter of the drive roll, the color image forming apparatus comprising:

a clock generator to generate a clock signal having a constant period in accordance with a rotation of the drive roll;

a counter to count the clock signal generated by the clock generator, wherein the counter counts the clock signal generated by the clock generator for a number corresponding to the multiple of the perimeter of the drive roll, thereby an image formation timing at a second image forming position in the second image forming portion is synchronized with an image formation timing at a first image forming position in the first image forming portion;

a base-clock generator to generate a base-clock signal at a period shorter than the clock generator;

a base-clock counter to count a number of the base-clocks generated by the base-clock generator during the period from a first image formation timing signal for deciding the image formation timing at the first image forming position to the clock signal generated by the clock generator;

a memory to store the number of the base-clocks counted by the base-clock counter; and a decrement counter to decrement a value of the base-clock stored in the memory by the number of the base-clocks generated by the base-clock generator, wherein the counter starts to count the clock signal in accordance with the first image formation timing signal for deciding the image formation timing at the first image forming position, and the base-clock counter counts the number of the base-clocks generated by the base-clock generator during the period between the first image formation timing signal and the clock signal to thereby store the counted number of the base-clocks in the memory, and the decrement counter starts to decrement the counted number of the base-clocks stored in the memory when the counter counts the clock signal for the number corresponding to the multiple of the perimeter of the drive roll, and delivers a second image formation timing signal for deciding the image formation timing at the second image forming position when a count value of the decrement counter becomes zero.

* * * * *